US007471203B2

(12) United States Patent
Worthy et al.

(10) Patent No.: US 7,471,203 B2
(45) Date of Patent: Dec. 30, 2008

(54) TAMPER MONITORING SYSTEM AND METHOD

(75) Inventors: David Worthy, Gilbert, AZ (US); Charles Glasser, Scottsdale, AZ (US); Yazid Sidi, Mesa, AZ (US); James Rodgers, Mesa, AZ (US)

(73) Assignee: RF Code, Inc., Austin, TX (US)

( * ) Notice: Subject to any disclaimer, the term of this patent is extended or adjusted under 35 U.S.C. 154(b) by 222 days.

(21) Appl. No.: 11/412,414

(22) Filed: Apr. 26, 2006

(65) Prior Publication Data

US 2006/0261959 A1 Nov. 23, 2006

Related U.S. Application Data

(60) Provisional application No. 60/675,336, filed on Apr. 26, 2005.

(51) Int. Cl.
*G08B 13/14* (2006.01)

(52) U.S. Cl. ..... 340/572.1; 340/556; 340/568.2

(58) Field of Classification Search ..... 340/572.1, 340/542, 555, 556, 568.1, 568.2
See application file for complete search history.

(56) References Cited

U.S. PATENT DOCUMENTS

| | | | | |
|---|---|---|---|---|
| 3,854,792 | A | 12/1974 | Koella | |
| 4,095,872 | A | 6/1978 | Stieff et al. | |
| 4,106,849 | A | 8/1978 | Stieff | |
| 4,161,348 | A | 7/1979 | Ukrich | |
| 4,262,284 | A | 4/1981 | Stieff et al. | |
| 4,297,684 | A | 10/1981 | Butter | |
| 4,367,460 | A | 1/1983 | Hodara | |
| 4,447,123 | A | 5/1984 | Page et al. | |
| 4,523,186 | A * | 6/1985 | Fiarman | 340/555 |
| 4,546,345 | A | 10/1985 | Naito | |
| 4,878,045 | A | 10/1989 | Tamaka et al. | |
| 5,111,184 | A | 5/1992 | Heaton et al. | |
| 5,189,396 | A | 2/1993 | Stobbe | |
| 5,406,263 | A | 4/1995 | Tuttle | |
| 5,515,030 | A | 5/1996 | Citron et al. | |
| 5,583,488 | A | 12/1996 | Sala et al. | |
| 5,612,675 | A | 3/1997 | Jennings et al. | |
| 5,646,592 | A | 7/1997 | Tuttle | |
| 5,831,531 | A | 11/1998 | Tuttle | |

(Continued)

FOREIGN PATENT DOCUMENTS

| | | |
|---|---|---|
| DE | 4142529 A1 | 7/1993 |

(Continued)

OTHER PUBLICATIONS

Martin, Brian W.; "Watch It. A fully supervised identification, location and tracking system;" Security Technology, 1995; pp. 306-310.

*Primary Examiner*—John A Tweel, Jr.

(57) ABSTRACT

A tamper monitoring system includes at least one active tag and a transmission link. The one active tag includes a transmitter and a receiver. The first end of the transmission link is connected to the transmitter and the second end is connected to the receiver. The transmitter is designed to transmit a non-constant signal to the transmission link to the receiver, and the receiver is designed to receive a signal from the transmission link and to correlate the received signal with the transmitted signal. When the received signal does not correlate with the transmitted signal, the active tag transmits a tamper beacon.

25 Claims, 4 Drawing Sheets

U.S. PATENT DOCUMENTS

| | | | | |
|---|---|---|---|---|
| 5,949,151 | A | 9/1999 | Nakajima | |
| 5,963,131 | A | 10/1999 | D'Angelo et al. | |
| 6,002,501 | A | 12/1999 | Smith et al. | |
| 6,037,867 | A | 3/2000 | Joseph et al. | |
| 6,040,763 | A | 3/2000 | Nakajima | |
| 6,049,273 | A | 4/2000 | Hess | |
| 6,069,563 | A | 5/2000 | Kadner et al. | |
| 6,104,311 | A | 8/2000 | Lastinger | |
| 6,265,973 | B1 | 7/2001 | Brammall et al. | |
| 6,340,932 | B1 | 1/2002 | Rodgers et al. | |
| 6,351,215 | B2 | 2/2002 | Rodgers et al. | |
| 6,362,737 | B1 | 3/2002 | Rodgers et al. | |
| 6,420,971 | B1 * | 7/2002 | Leck et al. | 340/556 |
| 6,552,661 | B1 | 4/2003 | Lastinger et al. | |
| 6,611,556 | B1 | 8/2003 | Koerner et al. | |
| 6,621,410 | B1 | 9/2003 | Lastinger et al. | |
| 6,624,760 | B1 | 9/2003 | Kinzel et al. | |
| 6,765,484 | B2 | 7/2004 | Eagleson et al. | |
| 6,831,562 | B2 | 12/2004 | Rodgers et al. | |
| 7,135,970 | B2 * | 11/2006 | Kowal et al. | 340/555 |
| 7,239,238 | B2 * | 7/2007 | Tester et al. | 340/568.2 |
| 7,274,293 | B2 * | 9/2007 | Bradus et al. | 340/568.2 |
| 2002/0011932 | A1 | 1/2002 | Rodgers et al. | |
| 2002/0067262 | A1 | 6/2002 | Lie | |
| 2002/0089434 | A1 | 7/2002 | Ghazarian | |
| 2002/0185544 | A1 | 12/2002 | Baillod | |
| 2003/0076230 | A1 | 4/2003 | Runyon et al. | |
| 2003/0174059 | A1 | 9/2003 | Reeves | |

FOREIGN PATENT DOCUMENTS

| | | | |
|---|---|---|---|
| EP | 1063627 | A2 | 12/2000 |
| EP | 1077440 | A1 | 2/2001 |
| EP | 1191495 | A2 | 3/2002 |

* cited by examiner

TAMPER MONITORING SYSTEM AND METHOD

CROSS REFERENCE TO RELATED APPLICATION

This application claims priority to U.S. Provisional Patent Application Ser. No. 60/675,336 filed Apr. 26, 2005 by Worthy et al., the entire disclosure of which is incorporated herein by reference.

FIELD OF THE INVENTION

This invention relates to a tamper monitoring system and method.

BACKGROUND OF THE INVENTION

Tags are small and inexpensive devices which may be attached to or put in objects, persons, vehicles, and aircraft. The tags may periodically transmit their identification code (ID), status, data and other information, and may also receive information, such as coordinate, setup, programming, control and/or other information. Active tags, operating on a commodity battery, are capable of several hundred feet of radial coverage. Hundreds or thousands of tags can be simultaneously detected and read.

In many applications, there is a need for a tag to have additional capabilities, such as providing tamper sensors and other inputs that are integrated with the tag. Specifically, there is a need for tags that can provide security for items, objects, material, vehicles or persons, in such a manner as to prevent entry, theft, sabotage or other detrimental activity. The tag may seal, or otherwise secure, items it is designed to protect but also to protect itself from being overcome or rendered ineffective.

Additionally, there is the need for a tag with communication capabilities and functions so that it can play a part in global monitoring, supply chain management and security management, with remote monitoring, control and processing capability, such as on an Internet website. In one example, a tamper tag employs a closed-loop fiber optic cable, where both ends of the cable are connected to the tag, and the cable is fed through, around or is attached to one or more items such as containers containing a critical or dangerous material. A light or infrared signal originating in the tag is fed to one end of the cable and detected at the other end by the same tag. Any attempt to disconnect, cut or remove the cable, is immediately detected and a tamper-initiated wireless signal, such as a radio signal, is sent to one or more receivers and a monitoring system.

In another example, it may be desired to globally monitor and track the movement of containers, mail, packages or other items, using the Internet, wireless networks, telephone lines and other communication means. The monitoring and tracking can be accomplished with signposts and local controller systems located in a ship, train, airplane, truck loading and unloading port and customs area. Signposts can interrogate a tamper tag on a container, sending a signpost ID, location, time and date stamp, and other status information that can be transmitted to a remote overall system controller, and/or stored in the tag in order to maintain a trip and incidence record, for reading upon arrival at a final destination. The tamper tag can also seal or secure the container and send an immediate alert signal if the container or tag integrity is being tampered with or if it has been tampered with in the past.

Conventional tag systems employ a wire or conductive cable, and measure the continuity of a voltage or current to confirm that tampering has not occurred. However, one can place a bypass connection, and then cut the wire with the system not detecting a tamper event. In a more complex case, a cable with an internal conductor and external connector is used, requiring that both connections be bypassed.

Other prior systems use an intermixing of fibers in a fiber optic bundle or cable so as to create a unique "fingerprint" of the output pattern. Fiber optics are highly advantageous since they provide high immunity to environment inputs such as moisture and electrical interference, do not create a conductive path, and do not require two conductors to create a circuit. However, prior systems are complex and costly because they require multiple receiving detectors, apertures, and lenses to read the optic pattern.

Other fiber optics systems use a visual light or infrared signal that is operated by a random number sequence. However, the number of alternatives is neither very high nor very random, because it is very difficult to create a high number of codes in a small tag. As a result, the "random" number can be easily analyzed and replicated, and a pattern can be ascertained and duplicated, to defeat the system.

Examples of conventional signpost, tag and receiver monitoring, tracking and locating systems include the following:

U.S. Pat. No. 6,420,971 discloses an electronic seal that has a housing and a closure member operable with the housing to form a seal. The electronic seal has a core and a sensor assembly for detecting tampering. The core is a fiber optic cable, and the sensor assembly includes an integrity sensor having an optical source and an optical detector.

U.S. Pat. No. 6,624,760 discloses a low-cost monitoring system that has an extremely low power consumption which allows remote operation of an electronic sensor platform (ESP) for a long period. The monitoring system provides authenticated message traffic over a wireless network and utilizes state-of-health and tamper sensors to ensure that the ESP is secure and undamaged. The system has a robust ESP housing suitable for use in radiation environments. With one base station (a host computer and an interrogator transceiver), multiple ESP's can be controlled at a single monitoring site.

U.S. Pat. No. 5,646,592 discloses a simple trip-wire or magnetic circuit for a shipping container. The trip-wire or magnetic circuit provides continuity, which is detected electrically. If the continuity is interrupted by a forced entry of the container, electrical detection means, such as a radio-frequency-identification (RFID) tag, will alert a monitoring station. Also a magnetic circuit and a detection device (RFID tag) can be embedded into a shipping article during manufacturing. The RFID tag would communicate with an interrogator unit, which can be connected to a host computer. The interrogator and/or the host computer would then monitor the shipping container's status (opened or closed).

U.S. Pat. No. 4,523,186 discloses a seal system for materials, which indicates changes in environmental conditions that evidence attempts to bypass the seal. The seal system includes a detector for reading an optical signal transmitted through a loop, and one or more additional detectors for detecting environmental changes. These detectors are operatively associated with the seal so that detection of a break in the optical signal or detection of environmental changes will cause an observable change in the seal.

In U.S. Pat. No. 4,447,123, a fiber optic seal includes a transparent seal body having two spaced apart cavities. The ends of a fiber optic cable are secured within the spaced apart cavities, respectively. An electronic verifier injects light into one of the cable ends via a plurality of illumination light guides fixed within the seal body between an external surface and the illumination cavity. Light emitted from the other end of the fiber optic cable is transmitted from the detection cavity to the exterior surface of the sealed body via a plurality of detection light guides. The light is measured and converted by the verifier to provide a seal signature.

These conventional tamper monitoring systems have several drawbacks. For example, the conventional systems measure the presence or absence of a simple or constant signal in a cable. This makes the system easy to tamper with, because the signal can be easily duplicated and the cable can be easily bypassed.

DISCLOSURE OF INVENTION

The present invention overcomes the problems of the conventional tamper monitoring system. In the present invention, a tag can transmit and/or receive a non-constant signal, such as a modulated, encoded or encrypted signal, over a security cable to make it very difficult to tamper with the cable or the tag.

In accordance with one aspect of the invention, a tamper monitoring system includes at least one tag and a transmission link. The one tag includes a transmitter and a receiver. The first end of the transmission link is connected to the transmitter and the second end to the receiver. The transmitter is designed to transmit a varying signal through the transmission link to the receiver, and the receiver is designed to receive a signal from the transmission link and to correlate the received signal with the transmitted signal. When the received signal does not correlate with the transmitted signal, the tag transmits a tamper beacon.

In accordance with another aspect of the invention, a tamper monitoring method includes transmitting a non-constant signal, such as a modulated, encoded or encrypted signal, from a transmitter of at least one tag through a transmission link to a receiver of the at least one tag, receiving a signal from the transmission link with the receiver, correlating the received signal with the transmitted non-constant signal, and activating the tag to transmit a tamper beacon when the received signal does not correlate with the transmitted signal.

In a preferred embodiment, the transmitter is an optic transmitter, the receiver is an optic receiver, the communication link is a fiber optic cable, and the tag is an active RFID tag.

The signals may be analog or digital and are preferably modulated, encoded and/or encrypted. The signals can be visible or invisible light, infrared, laser, electrical or acoustic signals, or a combination of two or more of these signals. The transmitted signal can be a pulse signal and can be modulated, encoded and/or encrypted by varying at least one of pulse length, pulse absolute-transmission time, and pulse amplitude.

The correlation of the received signal with the transmitted signal can be performed in various manners. For example, it may include comparing the characteristics and properties of the received signal with those of the transmitted signal. Alternatively, it may include determining a cause-and-effect relationship between the received signal and the transmitted signal. The correlation may further include comparing the received signal with the average of one or more previously received signals, and when the difference between the received signal and the average is greater than a predetermined value, the tag transmits a tamper beacon.

In another preferred embodiment, the at least one tag includes first and second active tags. The first tag includes the transmitter and the second tag includes the receiver to form an open-loop system.

The at least one tag is programmable by a signpost, a portable controller or a system transmitter.

DESCRIPTION

Figure 1:
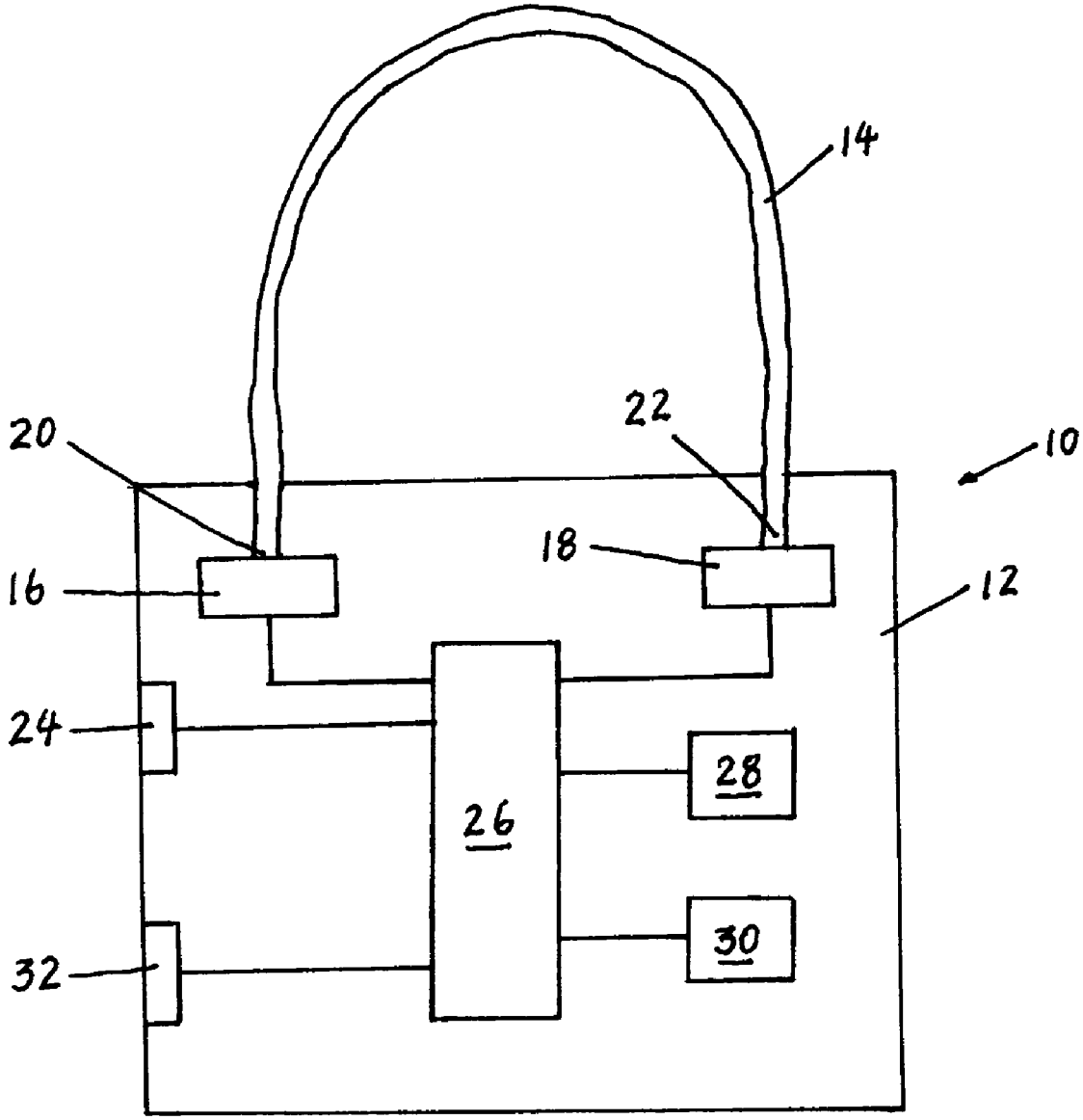
FIG. 1 is a schematic diagram showing a tamper monitor system of the present invention.

FIG. 1 illustrates a tamper monitoring system 10 of the present invention. The tamper monitoring system 10 includes a tag 12, such as an active RFID tag, and a transmission link 14. The tag 12 includes a transmitter 16 and a receiver 18. The first end 20 of the transmission link 14 is connected to the transmitter 16 and the second end 22 is connected to the receiver 18. The transmitter 16 is designed to transmit a non-constant signal, such as a modulated, encoded or encrypted signal, through the transmission link 14 to the receiver 18, and the receiver 18 is designed to receive a signal from the transmission link 14 and to correlate the received signal with the transmitted signal. When the received signal does not correlate with the transmitted signal, the tag 12 transmits a tamper beacon via a beacon transmitter 24. The tag 12 may also include a microprocessor 26, memory 28 and a battery 30, wherein the microprocessor 26 is used to control the transmitter 16 and receiver 18. The tag 12 may further include an interface device 32, such as a wireless transmitter/receiver, which can be used to communicate with signposts and/or with a local or remote monitoring system.

In this embodiment, the tag 12 preferably is an active RFID tag, and the transmission link 14 preferably is a fiber optic cable. The ends 20, 22 of the fiber optic cable 14 may be attached respectively to the transmitter 16 and receiver 18 of the RFID tag 12 in a loop arrangement. A light can be pulsed through the fiber optic cable 14 from the transmitter 16 to the receiver 18 as controlled by the RFID tag's microprocessor 26. The fiber optic cable 14 can be attached, wrapped around, inserted through or connected to some type of asset to be protected, tracked or secured.

The optic signal transmitted through the fiber optic cable 14 preferably is a pulse signal in order to minimize the tag power. The pulse signal can be a single pulse or a pulse having a fixed sub-carrier modulation or another type of modulation. The pulse signal can also be encoded and/or encrypted. When a signal is received by the receiver 18, a correlation, comparison and/or cause-and-effect evaluation can be performed on the pulse, carrier or sub-carrier frequency, coding, encryption, timing, width, amplitude and/or other analog and/or digital multi-dimensional characteristics of properties. This is then used to determine whether a tamper event has occurred. In the prior art, on the other hand, only the absence or presence of a simple or constant signal is determined.

Figure 3:
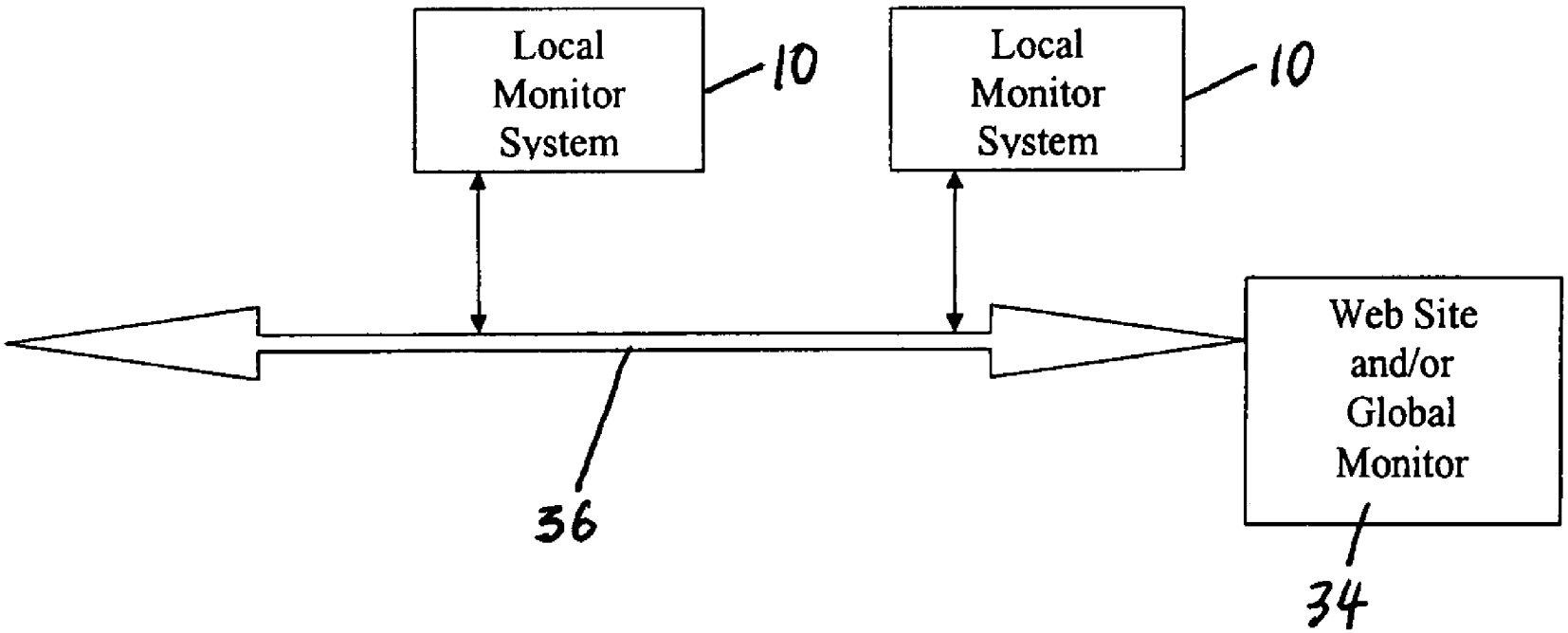
FIG. 3 is a schematic diagram showing a monitoring system of the present invention.

When the receiver 18 does not receive the expected pulses, a tamper event is declared and the active RFID tag 12 sends out a tamper beacon. The tamper beacon can be a wireless tamper beacon that is transmitted from a local tamper monitoring system 10 to a global monitoring system or a website 34 via a wireless network, a telephone network, and/or the Internet 36, as illustrated in FIG. 3. Upon receiving the tamper beacon, the monitoring system can sound an alarm or cause doors to close or to lock, lights to turn on and other similar warning or control activities, to secure or protect the item.

If no tamper event is detected, the tag 12 may send a self-initiated periodic signal or an optional signpost-initiated signal to confirm its presence, proper operation and status, including such information as its battery condition. In addition, the tamper monitoring system 10 can optionally operate with fixed magnetic, radio or infrared signposts, locators, interrogators and/or portable control units to provide setup, control, management and/or locating capabilities.

The above-described embodiment of the present invention has various advantages. For example, using a pulse optic signal transmitted through a fiber optic cable enhances security and reduces power consumption. Simply cutting the fiber optic cable and introducing a second light source would not be sufficient to defeat the tamper monitoring system, because the microcontroller may look for predetermined pulses both in amplitude and time. Additionally, the fiber optic cable has certain desirable qualities, such as its natural resistance to harsh environmental conditions such as heat, cold, ultra violet radiation, water, dust, ice and various corrosive elements or chemicals, and its resistance to electronic, capacitive or inductive interferences. A copper or other type of electrical cable can be "spliced" to a second cable so that the original cable can be severed without detection. With a fiber optic cable, any "slicing" would interrupt the light pulses traveling through it. Thus, the fiber optic cable provides improved tamper detection. Another advantage of the fiber optic cable is that the light transmitter and receiver do not need a common ground or power source. Each can be powered separately and can be a distance from each other, connected only by the fiber optic cable.

Figure 2:
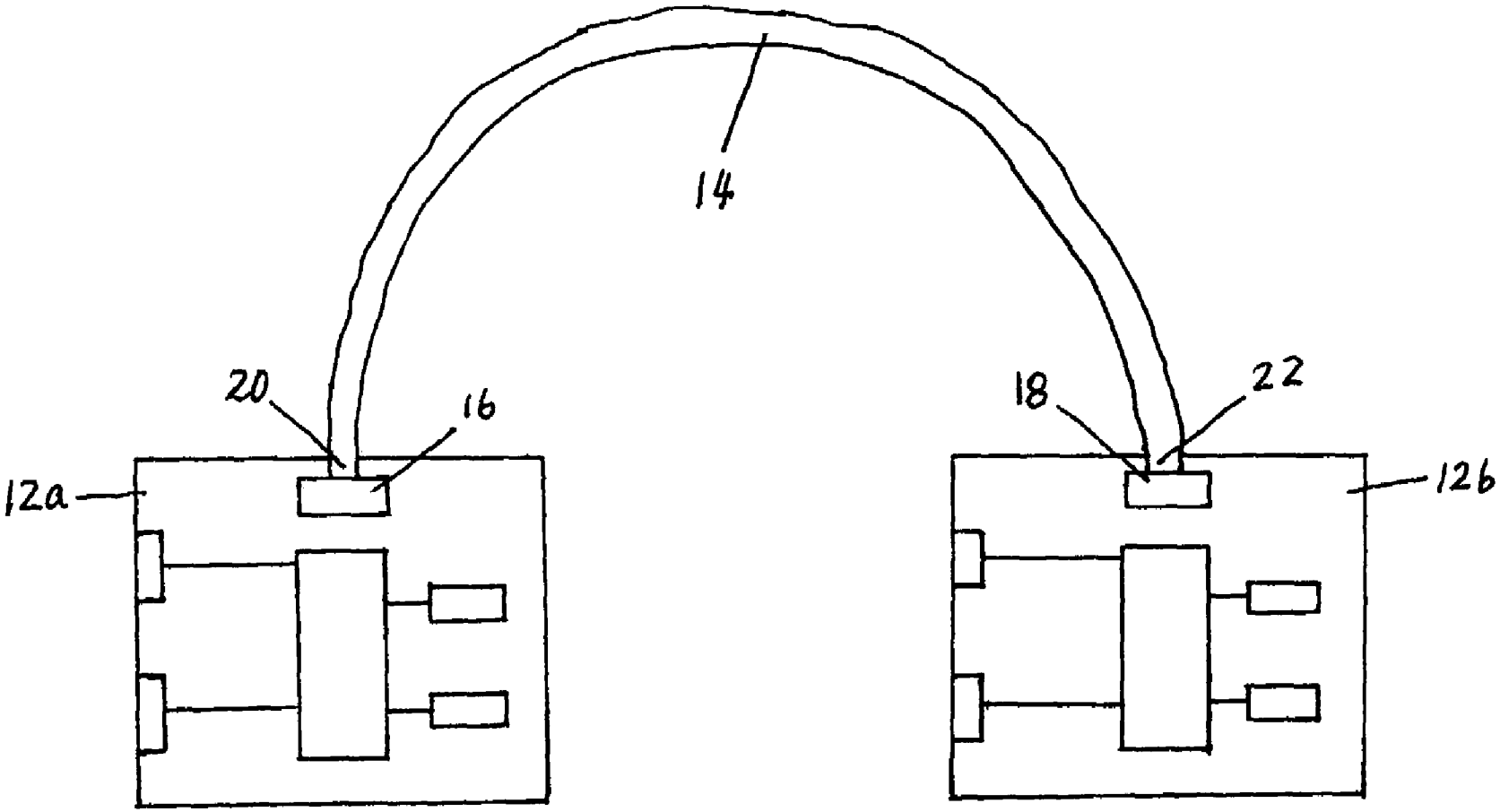
FIG. 2 is a schematic diagram showing another tamper monitor system of the present invention.

Although in the embodiment shown in FIG. 1 both ends 20, 22 of the fiber optic cable 14 are attached to the same tag 12 to form a closed loop, an open loop design, as shown in FIG. 2, is possible. In the embodiment shown in FIG. 2, the two ends 20, 22 of the fiber optic cable 14 are connected to two separate tags 12*a*, 12*b*, such as RFID tags. A signal with known characteristics or properties is sent from a transmitter 16 in one tag 12*a* through the fiber optic cable 14 to a receiver 18 in the other tag 12*b*. A valid signal at the receiver 18 indicates that tamper has not occurred.

In another preferred embodiment, the correlation, comparison and cause-and-effect evaluation can be performed adaptively. This may be performed by comparing, collating or evaluating the received signal with the average of one or more previously received signals, such as one or more preceding received signals. If the change is sufficiently abrupt, it is interpreted as a tamper event, but slow changes, within defined limits, are interpreted as changes cause by component aging, temperature, moisture or other non-detrimental factors and when the difference between the received signal and the average is greater than a predetermined value, the tag transmits a tamper beacon.

A signpost, a portable controller or a system transmitter can be used to activate and deactivate a tag in a secure manner or to change its properties such as its mode of operation, timing, coding, encryption, sensitivity, and so on.

Figure 4:
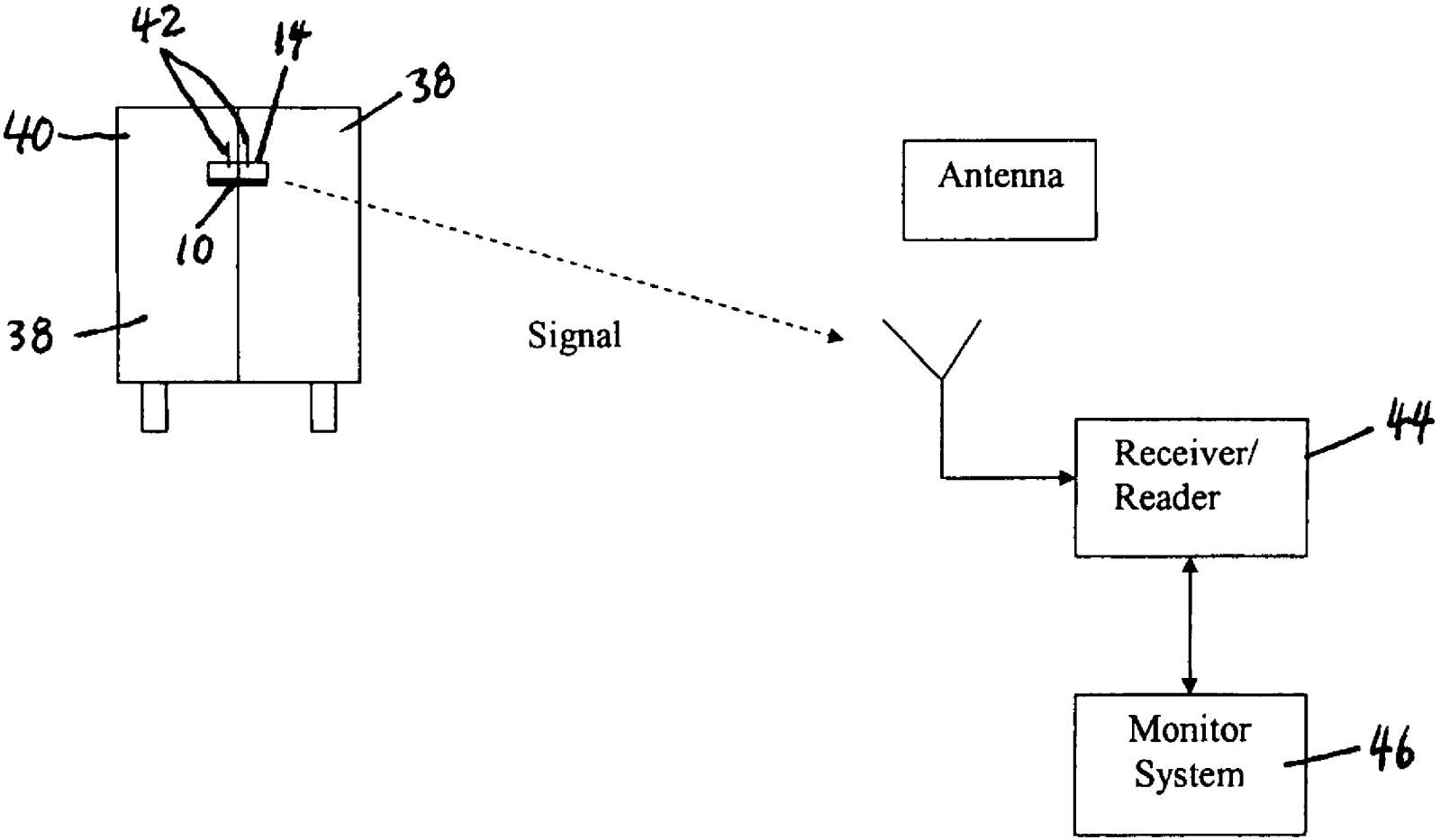
FIG. 4 is a schematic diagram showing an application of the present invention.

FIG. 4 illustrates an application of the tamper monitoring system of the present invention. In this example, a tamper monitoring system 10 is used to secure the rear doors 38 of truck 40. The cable 14 of the tamper monitoring system 10 is passed through two mounts 42 on the doors 38 so that opening the doors 38 breaks the cable 14. If the cable 14 is broken and the receiver 18 of the tamper monitoring system 10 does not receive the expected signal, the tag 12 of the tamper monitoring system 10 sends out a wireless tamper beacon. The wireless tamper beacon is transmitted from the local tamper monitoring system 10 to a receiver/reader 44 of a remote monitoring system 46. The wireless beacon can be further transmitted via a wireless network, a telephone network, and/or the Internet to a global monitoring system or a website. Upon receiving the tamper beacon, the remote monitoring system 46 can send out a warning signal.

Additionally, the system shown in FIG. 4 can be used to globally monitor and track the movement of the truck 40. The monitoring and tracking can be performed with signposts and local controller systems located along the road or at an intersection, gas station, rest area, and loading area. Signposts can interrogate the tamper tag and send a signpost identification, location, time and date stamp, and other status information to a globally monitoring and tracking system. Alternatively, the information can be stored in the tag in order to maintain a trip and incidence record for retrieval at a final destination.

What is claimed is:

1. A tamper monitoring system comprising:

at least one tag including a transmitter, and a receiver; and a transmission link having first and second ends, the first end being connected to the transmitter and the second end being connected to the receiver, wherein the transmitter is designed to transmit a non-constant signal through the transmission link to the receiver, wherein the receiver is designed to receive a signal from the transmission link and to correlate the received signal with the transmitted signal, wherein when the received signal does not correlate with the transmitted signal, the at least one tag transmits a tamper beacon, and wherein the correlation includes comparing the received signal with the average of one or more previously received signals, and wherein when the difference between the received signal and the average is greater than a predetermined value, the at least one tag transmits a tamper beacon.

2. The system of claim 1, wherein the transmitter is an optic transmitter, the receiver is an optic receiver, and the transmission link is a fiber optic cable.

3. The system of claim 1, wherein the at least one tag is an active RFID tag.

4. The system of claim 1, wherein the transmitted non-constant signal is encoded.

5. The system of claim 4, wherein the transmitted non-constant signal is a pulse signal and is encoded by varying at least one of pulse length, pulse absolute-transmission time, and pulse amplitude.

6. The system of claim 1, wherein the transmitted non-constant signal is encrypted.

7. The system of claim 6, wherein the transmitted non-constant signal is a pulse signal and is encrypted by varying at least one of pulse length, pulse absolute-transmission time, and pulse amplitude.

8. The system of claim 1, wherein the transmitted and received signals are analog signals.

9. The system of claim 1, wherein the transmitted and received signals are digital signals.

10. The system of claim 1, wherein the transmitted and received signals are infrared signals

11. The system of claim 1, wherein the transmitted and received signals are laser signals.

12. The system of claim 1, wherein each of the transmitted and received signals includes two or more of visible light, laser, infrared, and acoustic signals.

13. The system of claim 1, wherein the transmitted and received signals are electrical signals.

14. The system of claim 1, wherein the correlation of the received signal with the transmitted signal includes comparing the received signal with the transmitted signal.

15. The system of claim 1, wherein the correlation of the received signal with the transmitted signal includes determination of a cause-and-effect relationship between the received signal and the transmitted signal.

16. The system of claim 1, wherein the at least one tag includes first and second active tags, wherein the first active tag includes the transmitter and the second active tag includes the receiver.

17. The system of claim 1, wherein the at least one tag is programmable by a signpost, a portable controller or a system transmitter.

18. A tamper monitoring method comprising:

transmitting a non-constant signal from a transmitter of at least one tag though a transmission link to a receiver of the at least one tag;

receiving a signal from the transmission link with the receiver;

correlating the received signal with the transmitted non-constant signal, wherein correlating includes comparing the received signal with an average of one or more previously received signals; and activating the at least one tag to transmit a tamper beacon when the difference between the received signal and the average is greater than a predetermined value.

19. The method of claim 18 wherein the transmitter is an optic transmitter, the receiver is an optic receiver, and the transmission link is a fiber optic cable.

20. The method of claim 18, wherein the at least one tag is an active RFID tag.

21. The method of claim 18 wherein the transmitted non-constant signal is encoded.

22. The method of claim 21, wherein the transmitted non-constant signal is a pulse signal and is encoded by varying at least one of pulse length, pulse absolute-transmission time, and pulse amplitude.

23. The method of claim 18 wherein the transmitted non-constant signal is encrypted.

24. The method of claim 23, wherein the transmitted non-constant signal is a pulse signal and is encrypted by varying at least one of pulse length, pulse absolute-transmission time, and pulse amplitude.

25. The method of claim 18 wherein the correlation of the received signal with the transmitted signal includes determining a cause-and-effect relationship between the received signal and the transmitted signal.

* * * * *